US007780521B2

(12) United States Patent
Inamura

(10) Patent No.: US 7,780,521 B2
(45) Date of Patent: Aug. 24, 2010

(54) GAMING MACHINE AND GAMING SYSTEM

(75) Inventor: Yukinori Inamura, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 737 days.

(21) Appl. No.: 11/649,369

(22) Filed: Jan. 4, 2007

(65) Prior Publication Data

US 2007/0178958 A1 Aug. 2, 2007

(30) Foreign Application Priority Data

Jan. 9, 2006 (JP) ..... 2006-001945

(51) Int. Cl.
*A63F 5/04* (2006.01)
*G07F 17/34* (2006.01)

(52) U.S. Cl. ..... 463/25; 463/20; 463/31

(58) Field of Classification Search ..... 463/20, 463/25, 27, 42; 273/143 R
See application file for complete search history.

(56) References Cited

U.S. PATENT DOCUMENTS 5,178,390 A * 1/1993 Okada ..... 273/143 R
5,564,700 A * 10/1996 Celona ..... 463/27
5,695,402 A * 12/1997 Stupak ..... 463/20
6,113,493 A * 9/2000 Walker et al. ..... 463/25
6,244,958 B1 * 6/2001 Acres ..... 463/26
6,270,409 B1 * 8/2001 Shuster ..... 463/20

FOREIGN PATENT DOCUMENTS

JP 2003-169881 A 6/2003
JP 2004-016703 A 1/2004

* cited by examiner

*Primary Examiner*—James S. McClellan
*Assistant Examiner*—Lawrence Galka
(74) *Attorney, Agent, or Firm*—Arent Fox LLP

(57) ABSTRACT

Based on that the insurance BET operation portion 7 is operated, the specific winning prize lottery process (S14) is executed to determine the specific winning prize, which does not become the count object, among plural prizes by the lottery. And the number of times of game, which becomes the winning prize other than the specific winning prize according to the lottery result, is counted in the count process of game number of times (S21), and at the time that the number of times of game reaches to the predetermined number of times of game for giving the threshold prize, the special payout is given to the player.

5 Claims, 12 Drawing Sheets

FIG. 2

| | LEFT REEL | CENTER REEL | RIGHT REEL |
|---|---|---|---|
| CODE No. | SYMBOL | SYMBOL | SYMBOL |
| 00 | JACKPOT 7 | JACKPOT 7 | JACKPOT 7 |
| 01 | PLUM | BELL | CHERRY |
| 02 | ORANGE | APPLE | ORANGE |
| 03 | PLUM | BELL | APPLE |
| 04 | ORANGE | CHERRY | ORANGE |
| 05 | PLUM | ORANGE | PLUM |
| 06 | ORANGE | PLUM | ORANGE |
| 07 | PLUM | CHERRY | PLUM |
| 08 | BLUE 7 | BELL | ORANGE |
| 09 | CHERRY | APPLE | PLUM |
| 10 | ORANGE | BELL | ORANGE |
| 11 | BELL | STRAWBERRY | PLUM |
| 12 | ORANGE | PLUM | BELL |
| 13 | STRAWBERRY | BLUE 7 | STRAWBERRY |
| 14 | BLUE 7 | BELL | BLUE 7 |
| 15 | ORANGE | APPLE | BELL |
| 16 | APPLE | BELL | CHERRY |
| 17 | PLUM | STRAWBERRY | PLUM |
| 18 | ORANGE | PLUM | ORANGE |
| 19 | PLUM | CHERRY | PLUM |
| 20 | BLUE 7 | BELL | ORANGE |
| 21 | CHERRY | APPLE | PLUM |

FIG. 7

| PRIZE | | | PROBABILITY (%) FOR REALIZING | PAYOUT NUMBER |
|---|---|---|---|---|
| JACKPOT 7 | JACKPOT 7 | JACKPOT 7 | 0.5 | PAYOUT OF ACCUMULATED SUM |
| BLUE 7 | BLUE 7 | BLUE 7 | 0.8 | 10 |
| BELL | BELL | BELL | 1.1 | 8 |
| APPLE | APPLE | APPLE | 1.3 | 7 |
| CHERRY | CHERRY | CHERRY | 1.5 | 5 |
| STRAWBERRY | STRAWBERRY | STRAWBERRY | 1.5 | 5 |
| PLUM | PLUM | PLUM | 1.8 | 4 |
| ORANGE | ORANGE | ORANGE | 2.3 | 3 |
| CHERRY | CHERRY | (ANY) | 3.0 | 2 |
| ORANGE | ORANGE | (ANY) | 3.0 | 2 |
| CHERRY | (ANY) | (ANY) | 7.5 | 1 |
| ORANGE | (ANY) | (ANY) | 7.5 | 1 |

GAMING MACHINE AND GAMING SYSTEM

CROSS-REFERENCE TO THE RELATED APPLICATIONS (S)

This application is based upon and claims a priority from the prior Japanese Patent Application No. 2006-001945 filed on Jan. 9, 2006, the entire contents of which are incorporated herein by reference.

BACKGROUND OF THE INVENTION

1. Field of the Invention

The present invention relates to a gaming machine and a gaming system in which one winning prize is determined by a lottery among plural winning prizes, such lottery result is displayed and a benefit corresponding to the lottery result is given. In particularly, the present invention relates to a gaming machine and a gaming system in which a number of times of game satisfying a predetermined condition is counted and when such number of times of game reaches to a predetermined number of times of game, a special benefit is given.

2. Description of Related Art

Conventionally, in gaming machines such as Pachinko game machines, Japanese Pachi-slot game machines and slot machines, in a case that a big prize according to which a large benefit is given does not occur for a predetermined period, in order to retain game interest of a player, a predetermined special benefit (so-called threshold prize) is given. Such special prize is given independently of the lottery result to the player who almost loses game interest because of no big prize for a predetermined period, thereby delight in excess of desire is given to the player. Therefore, decreasing game interest can be recovered and improved.

Such gaming machine having threshold function to give the threshold prize is already well-known for players, thus there will be a case that the player can recognize that the threshold prize will occur in the immediate future. And there exist many gaming machines having function to inform the number of times of game necessary to reach to the threshold prize. In such cases, for players who can grasp that the threshold prize will be given, the effect of the threshold prize becomes comparatively small. That is to say, although giving the threshold prize sufficiently realizes the effect to raise the game interest of the player based on that unexpected benefit is given to the player, such giving the threshold prize becomes a benefit given within expected range for the player who can predict the threshold prize which will be given. Thus, such threshold prize becomes nothing but general delight to the same extent as the ordinary benefit.

Here, it is disclosed in Unexamined Japanese Publication No. 2003-169881 a gaming machine in which a number of times of game necessary to reach to a state that the threshold prize is given can be voluntarily set. And in Unexamined Japanese Publication No. 2004-16703, it is disclosed a gaming machine in which a number of times of game necessary to reach to the state that the threshold prize is given is changed when a predetermined condition is satisfied.

In the gaming machines disclosed in Unexamined Japanese Publication No. 2003-169881 and Unexamined Japanese Publication No. 2004-16703, based on that the number of times of game necessary to reach to the state that the threshold prize is given is voluntarily set and such number is changed, grasp of the number of times of game to reach to the state that the threshold prize is given is made hard. Thereby, the threshold prize is given as unexpected benefit and game interest of the player is raised.

However, in the gaming machines disclosed in Unexamined Japanese Publication No. 2003-169881 and Unexamined Japanese Publication No. 2004-16703, in case of a prize (including loss of game) except for some special prize (for example, "increasing prize" in Unexamined Japanese Publication No. 2003-169881 and "big prize" in Unexamined Japanese Publication No. 2004-16703), such game obtaining the prize is certainly counted as the number of times of game. Therefore, for example, in a case that the number of times of game can be grasped such as a case that it is displayed the number of times of game necessary to reach to the threshold prize, a timing according to which the threshold prize is given can be surely grasped. Namely, a period that the player, who grasps the timing that the threshold prize is given, is expecting the threshold prize becomes a short period.

Here, since the player expecting the threshold prize becomes an enhanced state on the basis of expectation for a period capable of expecting the threshold prize, it concludes that one phase of game interest is realized. That is to say, there will exist problems that the player cannot sufficiently enjoy the game interest corresponding to expectation that the threshold prize may be given.

SUMMARY OF THE INVENTION

The present invention has been done and has an object to provide a gaming machine and a gaming system in which a number of times of game satisfying a predetermined condition is counted, and when such number of times of game reaches to a predetermined number of times, a special benefit is given, thereby interest of expectation for the special benefit can be sufficiently enjoyed.

In order to accomplish the above object, according to one aspect of the present invention, it is provided a gaming machine comprising:

a display device; and a processor programmed to operate with the display device (a) to determine one winning prize among plural winning prizes by a lottery, (b) to display a lottery result on the display device, (c) to give a benefit based on the winning prize determined by the lottery, (d) to determine a specific winning prize among plural winning prizes, (e) to count a number of times of game other than game in which the specific wining prize is won, and (f) to give a special benefit when a count result counted thereby becomes a predetermined number of times of game.

And according to another aspect of the present invention, it is provided a gaming system comprising a gaming machine and a server capable of communicating with the gaming machine, wherein the gaming machine comprises:

a display device; and a first processor programmed to operate with the display device (a) to determine one winning prize among plural winning prizes by a lottery, (b) to display a lottery result on the display device and (c) to give a benefit based on the winning prize determined by the lottery, wherein the server comprises a second processor to operate with the gaming machine (d) to determine a specific winning prize among plural winning prizes, (e) to count a number of times of game other than game in which the specific wining prize is won and (f) to give a special benefit when a count result counted thereby becomes a predetermined number of times of game.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

In the drawings,

FIG. 2 is a schematic view showing symbol columns described on outer peripheries of reels, FIG. 7 is a table showing winning prizes, realizable probabilities of winning prizes and payouts of the slot machine according to the first embodiment.

DETAILED DESCRIPTION OF THE PREFERRED EMBODIMENTS

First Embodiment

Hereinafter, with reference to the drawings, a gaming machine and a gaming system according to the present invention will be described according to the first embodiment which is embodied in a slot machine 1.

A slot machine 1 and a gaming system 105 according to the first embodiment have a so-called progressive function according to which a part of coins (for example, 1%) consumed in games is accumulatively added as the JACKPOT and such accumulated coins are paid out at once as a high payout to a player playing at the slot machine 1 in which a predetermined condition is satisfied.

Further, in the slot machine 1 and the gaming system 105, in a case that the game satisfying a predetermined condition is conducted by a predetermined number of times in the slot machine 1, a special payout giving function (so-called, threshold function) is provided with the slot machine 1. Concretely, it is counted the number of times of game in which a prize (including loss of game) other than a special winning prize determined in the special winning prize lottery process (S14) mentioned later is determined as a lottery result, and when such counted result reaches to a predetermined number of times to give the threshold prize (for example, 600 games), the special payout (for example, 500 credits) is given to the player who plays the games corresponding to the number of times (corresponding to 600 times) to give the threshold prize.

Figure 4:
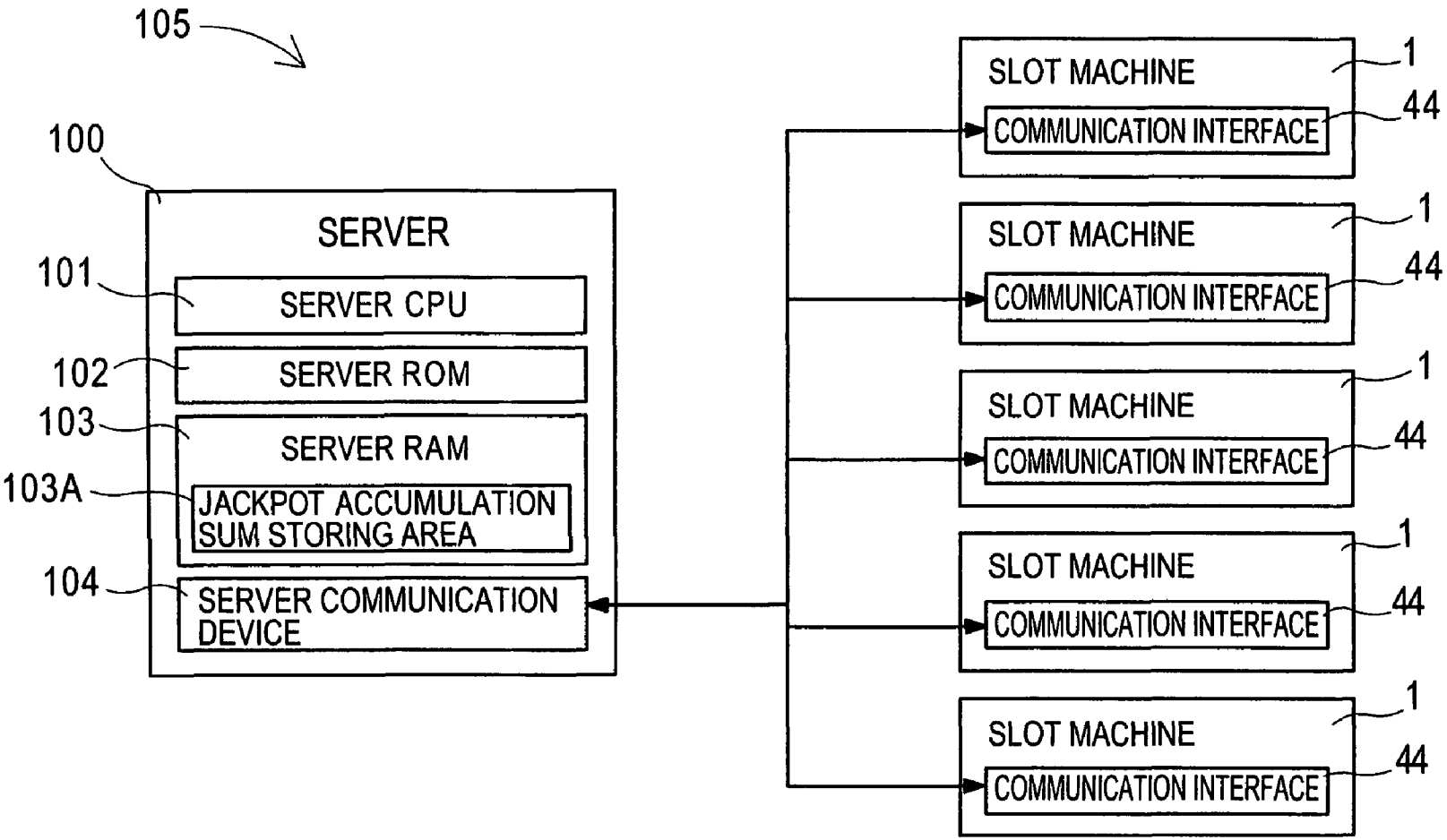
FIG. 4 is a block diagram showing a control system of a gaming system according to the first embodiment.

And as shown in FIG. 4, the gaming system 105 is constructed by connecting plural slot machines 1 and a server 100 controlling the slot machines 1, respectively.

Figure 1:
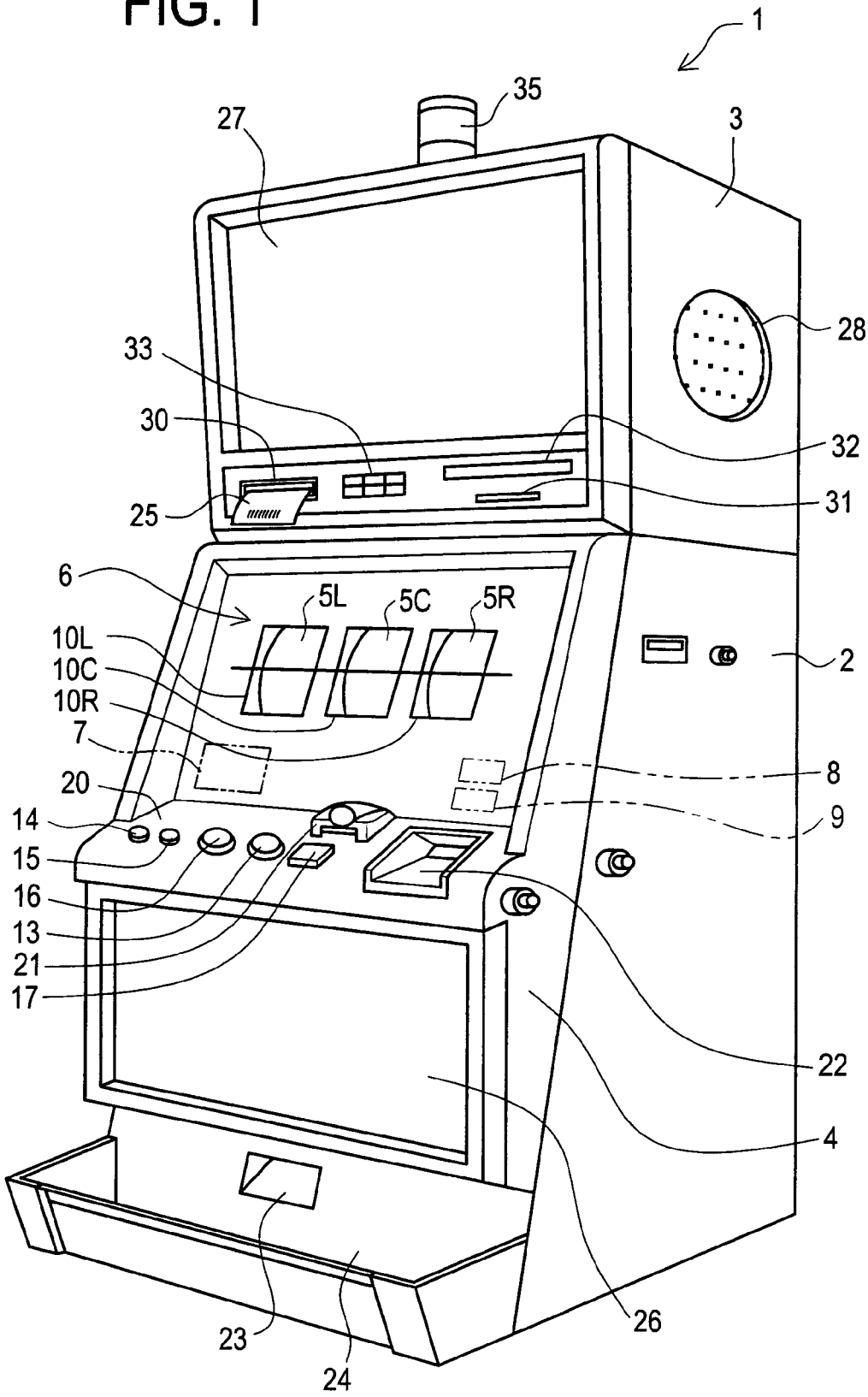
FIG. 1 is a perspective view showing an outline construction of a slot machine according to the first embodiment.

At first, an outline construction of the slot machine 1 according to the first embodiment will be described with reference to FIG. 1. FIG. 1 is a perspective view of the slot machine according to the first embodiment.

The slot machine 1 of the first embodiment has a cabinet 2, a top box 3 arranged on an upper side of the cabinet 2 and a main door 4 arranged on a front plane of the cabinet 2. In the cabinet 2, three reels 5L, 5C, 5*r* are rotatably arranged. Here, on an outer periphery of each reel 5L, 5C, 5R, a symbol column constructed from 22 symbols is described (see FIG. 2).

And in front of each reel 5L, 5C, 5R in the main door 4, a lower image display panel 6 is arranged. The lower image display panel 6 has a transparent liquid crystal panel, and various kinds of information concerning the game and effect images are displayed on the lower image display panel 6 during the game.

Further, in front of the lower image display panel 6, a touch panel 11 (see FIG. 3) is arranged and the player can input various instructions by operating the touch panel 11. Here, an insurance BET operation mentioned later is conducted by operating a specific portion for insurance BET operation of the touch panel 11.

On the lower image display panel 6, an insurance BET operation portion 7, a credit number display portion 8 and a payout number display portion 9 are formed. The insurance BET operation portion 7 is a portion to voluntarily conduct a BET operation of credits in excess by the player. Here, as mentioned later, the operation of the insurance BET operation portion 7 is detected through the touch panel 11 arranged in front of the lower image display panel 6, and based on such detection, the insurance BET is conducted. In the credit number display portion 8, the credit number held by the player at present is displayed. In the payout number display portion 9, it is displayed a payout sum given as the payout number when a symbol combination stopped and displayed on a pay line L is a predetermined winning symbol combination.

On the lower image display panel 6, three display windows 10L, 10C, 10R through which rear sides thereof can be seen are formed, and three symbols described on the outer periphery of each reel 5L, 5C, 5R are displayed through each of the display windows 10L, 10C, 10R. A pay line L horizontally crossing three display windows 10L, 10C, 10R is formed on the lower image display panel 6. The pay line L rules a symbol combination. When the symbol combination stopped and displayed on the pay line L is a predetermined symbol combination, a payout sum corresponding to such symbol combination and a credit number (bet number) is given to the player.

Under the lower image display panel 6 there are provided a control panel 20 on which a plurality of buttons to input instructions according to game progress by the player are arranged, a coin insertion slot 21 to insert coins as game media in the cabinet 2 and a bill validator 22.

On the control panel 20, a spin button 13, a change button 14, a CASHOUT button 15, a 1-BET button 16 and a MAX-BET button 17 are arranged. The spin button 13 is operation means to input instruction for starting rotation of the reels 5L, 5C, 5R. The change button 14 is operation means used when the player requires exchange to a shop keeper of the game arcade. The CASHOUT button 15 is operation means to input instruction for paying coins (one coin corresponds to one credit) from a coin payout opening 23 to a coin tray 24 corresponding to the credit number held by the player or to input instruction for paying coins by using a ticket with bar code 25 mentioned later.

The 1-BET button 16 is operation means to accept instruction for betting one credit among credits held by the player. The MAXBET button 17 is operation means to accept instruction for betting a maximum credit number (for example, 50 credits) bettable for one game among credits held by the player.

Within the coin insertion slot 21 a reverter 21S and a coin counter 21C (see FIG. 3) are provided. And it is distinguished by the reverter 21S whether or not coins inserted through the coin insertion slot 21 are true, and coins other than true coins are removed from the coin payout opening 23. The true coins received are detected and a number of coins is counted by the coin counter 21C.

The bill validator 22 distinguishes whether or not bills are true, thereby true bills are accepted in the cabinet 2. The bill inserted in the cabinet 2 is converted into a number of coins and the credits corresponding to the number of coins converted are added as the credits held by the player. Here, the bill validator 22 is constructed so as to be able to read out the ticket with bar code 25. On the under front plane of the main door 4, that is, under the control panel 20, a berry glass 26 on which characters of the slot machine 1 are described is arranged.

Here, in the slot machine 1 of the first embodiment, coins, bills or valuable electronic information (credit) corresponding thereto are utilized as game media. However, game media adoptable for the present invention are not limited to the above. For example, medals, tokens, electronic money or tickets can be utilized.

On the front plane of the top box 3, an upper image display panel 27 is arranged. The upper image display panel 27 has a liquid crystal panel, and for example, various kinds of information such as accumulative JACKPOT sum at present and explanation of game contents are displayed. And in the first embodiment, if the threshold function is activated, a threshold information display 27A (see FIG. 10) indicating information (for example, number of times of game) concerning a special payout (so-called, threshold prize) is done.

Here, a speaker 28 outputting sounds is arranged on the side plane of the top box 3.

Under the upper image display panel 27, a ticket printer 30, a card reader 31, a data display device 32 and a keypad 33 are provided.

Here, the ticket printer 30 is a printing device to output the ticket with bar code on which a bar code is printed, in the bar code data of the credit number and ID number of the slot machine 1 being encoded. The player can play the game at such gaming machine by reading out the output ticket with bar code 25 through the other gaming machine. As mentioned, the player can use the ticket with bar code 25 when conducting procedures at a predetermined place in the game arcade.

The card reader 31 conducts reading and writing of the data for a smart card. The smart card is a card held by the player, and for example, data concerning a history of the game conducted by the player are stored.

The data display device 32 is constructed from a fluorescent display and the like, and for example, data read out by the card reader 31 and data input through the keypad 33 by the player are displayed. The keypad 33 is utilized when instruction or data concerning ticket publication are input. Further, on the top plane of the top box 3, a lamp 35 is arranged. The lamp 35 is turned on in a predetermined manner when the player calls the shop keeper in the game arcade based on that errors occur in the slot machine 1.

Next, with reference to FIG. 2, it will be described symbols which are formed on the outer periphery of each reel 5L, 5C, 5R and are variably displayed while scrolling through the display windows 10L, 10C, 10R of the lower image display panel 6 when the game is conducted. FIG. 2 is a schematic view of symbol columns formed on the outer peripheries of the reels 5L, 5C, 5R.

On the outer periphery of each of the left reel 5L, the center reel 5C and the right reel 5R, 22 symbols are formed respectively. Each symbol column is constructed from the symbols of "JACKPOT7", "BLUE7", "BELL", "CHERRY", "STRAWBERRY", "PLUM", "ORANGE" and "APPLE" by combining them. As shown in FIG. 2, on each reel 5L, 5C, 5R, a predetermined number of symbols are arranged according to a predetermined order.

When three symbols of "BLUE", "CHERRY", "STRAWBERRY", "PLUM", "ORANGE", "APPLE" are stopped and displayed on the pay line L, a preset payout sum is given to the player (see FIG. 7). And as for "CHERRY" and "ORANGE", even if one or two symbols thereof are stopped and displayed on the pay line L, a preset payout sum according to the number thereof is given to the player (see FIG. 7).

As described above, the slot machine 1 of the first embodiment has the so-called progressive function according to which a part (for example, 1%) of coins paid for games is accumulatively added as the JACKPOT and such coins are paid out at once as the high payout for the player playing in the slot machine 1 satisfying a predetermined condition.

Here, the combination of "JACKPOT7" constructs one condition as the predetermined condition mentioned above. That is to say, if three symbols of "JACKPOT7" are stopped and displayed on the pay line L, the accumulated sum of JACKPOT at that time is given to the player.

And the symbol columns formed on the reels 5L, 5C, 5R are scrolled from the upper position to the lower position in the display windows 10L, 10C, 10R according to rotation of the reels 5L, 5C, 5R when the spin button 13 is pressed after the bet number is confirmed by operation of the 1-BET button 16 or the MAXBET button 17. After a predetermined period elapses, the symbol columns are stopped and displayed in the display windows 10L, 10C, 10R when the reels 5L, 5C, 5R are stopped. Here, various prizes (see FIG. 7) are predetermined based on the symbol combinations and when the symbol combination corresponding to the prize is stopped on the pay line L, the payout sum corresponding to the prize is given to the player.

Figure 3:
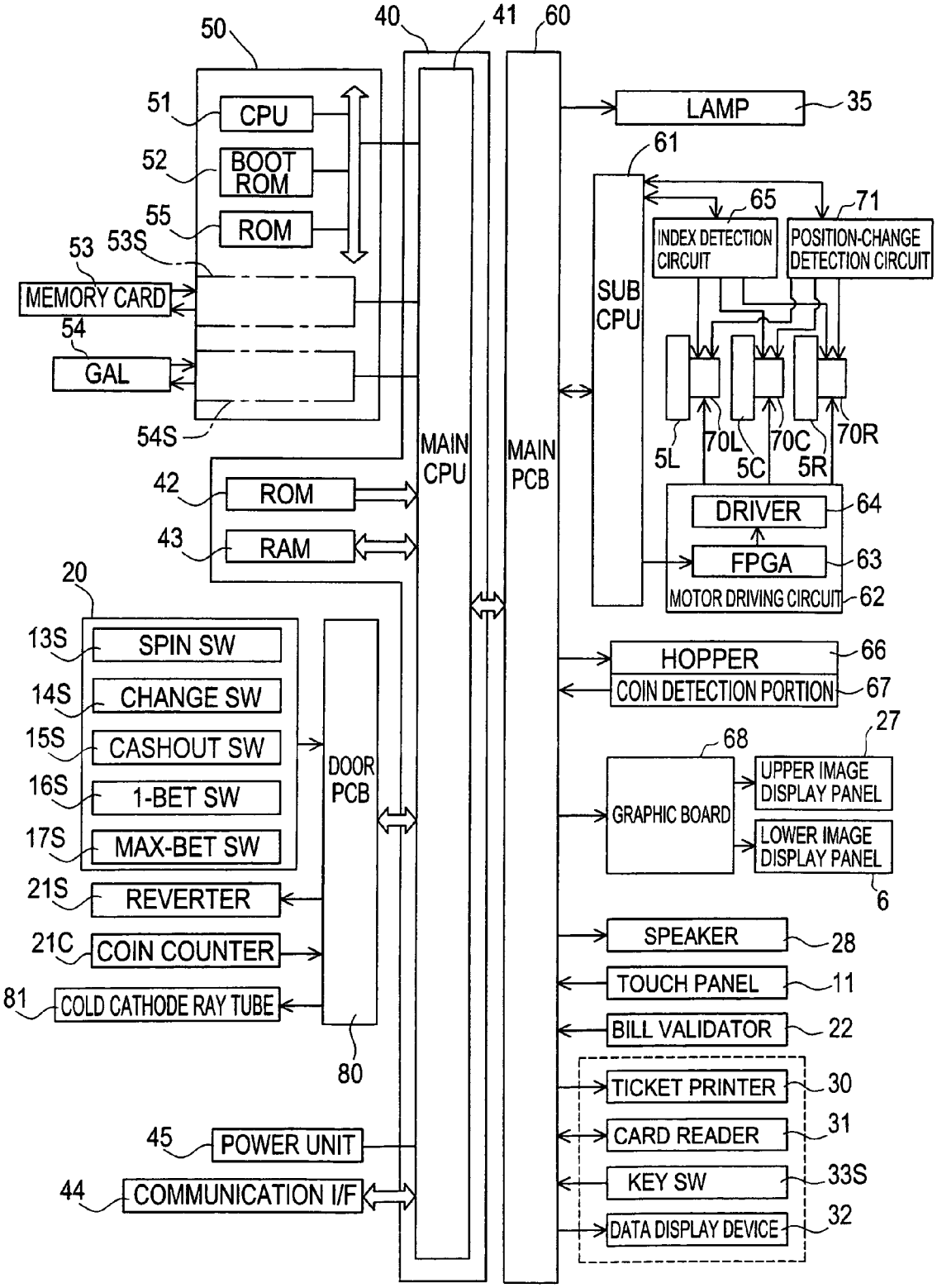
FIG. 3 is a block diagram showing a control system of the slot machine according to the first embodiment.

Next, a construction of control system in the slot machine 1 according to the first embodiment will be described with reference to FIG. 3. FIG. 3 is a block diagram schematically showing the control system of the slot machine 1 of the first embodiment.

As shown in FIG. 3, the control system of the slot machine 1 is basically constructed from a mother board 40 and a gaming board 50.

At first, the gaming board 50 will be described. The gaming board 50 is provided with a CPU 51, a ROM 55, a boot ROM 52, a card slot 53S corresponding to a memory card 53 and an IC socket 54S corresponding to a GAL (Generic Array Logic), all elements being connected each other.

The memory card 53 is constructed from a non-volatile memory, and a game program and a game system program (hereinafter, called as game programs) are recorded in the memory card 53. In the game programs recorded in the memory card 53, a lottery program is included. This lottery program is a program to determine the symbols (code numbers corresponding to symbols) of the reels 5L, 5C, 5R stopped and displayed on the pay line L. And in the lottery program, data for weighing symbol corresponding to each of plural kinds of payout rates (for example, 80%, 84%, 88%) are included. The data for weighing symbol are data indicating a correlation between code No. (see FIG. 2) of each symbol and one or plural random number values belonging to a predetermined value range (0~255). That is to say, one or plural random number values are corresponded to one symbol, and based on that a random number is extracted, the symbol specified by such random number is stopped and displayed.

The payout rate is determined based on data for setting the payout rate, such data being output from the GAL 54, and the lottery is conducted based on the data for weighing symbol corresponding to such payout rate.

The card slot 53S is constructed so that the memory card 53 can be inserted therein and removed therefrom and is connected to the mother board 40 through an IDE bus. Therefore, by rewriting the game programs stored in the memory card 53, the kind and contents of game played in the slot machine 1 can be changed. And by exchanging the memory card 53 with the other memory card 53 storing another game programs, the kind and contents of game played in the slot machine 1 can be also changed.

Here, in the game programs, a program controlling game progress, image data output during the game, sound data, image and sound data utilized as information data are included.

The GAL 54 is a kind of PLD having OR fixed type array construction. The GAL 54 has a plurality of input ports and output ports, and when predetermined data are input to the input port, data corresponding to such data are output from the output port. Such data output from the output port are the data for setting the payout rate mentioned above.

The IC socket 54S is constructed so that the GAL 54 can be attached thereto and removed therefrom, and are connected to the mother board 40 through the PCI bus. Therefore, by rewriting the GAL 54 or exchanging the GAL 54 itself, the data for setting the payout rate output from the GAL 54 can be changed.

The CPU 51, the ROM 55 and the boot ROM 52, which are connected through the inner bus to each other, are connected to the mother board 40 through the PCI bus. The PCI bus conducts signal transmission between the mother board 40 and the gaming board 50 and conducts power supply from the mother board 40 to the gaming board 50. In the ROM 55, country identification information and a verifying program are stored. In the boot ROM 52, a preliminary verifying program and a program (boot code) to start the preliminary verifying program by the CPU 51 are stored.

The verifying program is a program (falsification check program) to verify the game programs. The verifying program is written according to procedures to check falsification of the game programs which become an object of verification execution process. The preliminary verifying program is a program to verify the verifying program mentioned above, and is written according to procedures to check falsification of the verifying program which becomes an object of verification process.

Next, the mother board 40 will be described. The mother board 40 is constructed by utilizing a well-known mother board (print wired board on which basic parts of a personal computer are mounted) on the market, and has a main CPU 41, a ROM 42, a RAM 43 and a communication interface 44.

The ROM 42 is formed from a memory device such as a flash memory and a program such as BIOS executed by the main CPU 41 and permanent data are stored therein. When the BIOS is executed by the main CPU 41, periphery devices are initialized, and installation process of the game programs stored in the memory card 53 is started through the gaming board 50.

In the RAM 43, data and programs utilized when the main CPU 41 operates are stored. The RAM 43 is memory means which can temporarily store various kinds of information such as the credit number held by the player.

The communication interface 44 is a communication device to communicate with the server 100 (see FIG. 4) installed in the game arcade through the communication line. In the first embodiment, the slot machine 1 is utilized for communicating with the server 100 so as to transmit and receive the bet information in a main game process (S2) mentioned later and the lottery result of a prize lottery process in a base game.

To the mother board 40, a main PCB 50 mentioned later and a door PCB 80 are respectively connected by a USB. And to the mother board 40, a power unit 45 is connected. When electric power is supplied to the mother board 40 from the power unit 45, the main CPU 41 of the mother board 40 is started to operate. Further, electric power is supplied to the gaming board 50 through the PCI bus, thereby the CPU 51 is started to operate.

To the main PCB 60 and the door PCB 80, there are connected devices occurring input signals to the main CPU 41 and devices operation of which is controlled through control signals from the main CPU 41. The main CPU 41 executes the game programs stored in the RAM 43 based on the input signal input thereto. And the main CPU 41 conducts predetermined calculation processes, thereby conducts storing the calculation result in the RAM 43 and control process for each of the devices.

To the main PCB 60, there are connected the lamp 35, the sub-CPU 61, the hopper 66, the coin detection portion 67, the graphic board 68, the speaker 28, the touch panel 11, the bill validator 32, the ticket printer 30, the card reader 31, the key switches 33S and the data display device 32.

The sub-CPU 61 conducts control of rotation and stop of the reels 5L, 5C, 5R. To the sub-CPU 61, it is connected a motor drive circuit 62 having the FPGA (Field Programmable Gate Array) 63 and the driver 64. The FPGA 63 is an electronic circuit constructed from LSI which is programmable and functions as a control circuit of stepping motors 70L, 70C, 70R. The driver 64 functions as an amplifying circuit of pulses input to the stepping motors 70L, 70C, 70R. And to the motor drive circuit 62, the stepping motors 70L, 70C, 70R, which are stepping motors to rotate the reels 5L, 5C, 5R by 1-2 phase excitation are connected.

To the sub-CPU 61, an index circuit 65 and a position change detection circuit 70 are connected. The index circuit 65 detects positions (for example, standard positions) of the reels 5L, 5C, 5R which are rotating and detects rotational deviation of the reels 5L, 5C, 5R.

The position change detecting circuit 71 changes stop positions of the reels 5L, 5C, 5R after the reels 5L, 5C, 5R stop. For example, the position change detection circuit 71 changes stop positions of the reels 5L, 5C, 5R when positions of the reels 5L, 5C, 5R are forcibly changed by the player so as to become a winning combination corresponding to a winning symbol combination in spite that the winning symbol combination is not obtained.

The hopper 66 is arranged in the cabinet 2 and pays out a predetermined number of coins form the coin payout opening 23 to the coin tray 24 based on the control signal output from the main CPU 41. The coin detection portion 67 is arranged within the coin payout opening 23, and when the coin detection portion 67 detects a predetermined number of coins paid out from the coin payout opening 23, the coin detection portion 67 outputs an input signal to the main CPU 41.

The graphic board 68 controls image display on the upper image display panel 27 and the lower image display panel 6, based on the control signal output from the main CPU 41. For example, in the credit number display portion 8, the credit number held by the player stored in the RAM 43 is displayed. And in the payout number display portion 9, the payout number of payout is displayed.

Here, the graphic board 68 is provided with the VDP (Video Display Processor) forming image data based on the control signal output from the main CPU 41 and the video RAM temporarily storing image data formed by the VDP.

The bill validator 22 distinguishes whether or not a bill and the ticket with bar code 25 are true and accepts the true bill and the true ticket with bar code 25 into the cabinet 2. When the bill validator 22 accepts the true bill, the bill validator 22 outputs an input signal to the main CPU 41 based the sum of such accepted bill. And the bill validator 22 outputs an input signal to the main CPU 41 based on the number of coins recorded in the true ticket with bar code 25.

The ticket printer 30 prints a bar code encoded on the basis of data of the credit number stored in the RAM 43 on a ticket and outputs such ticket as the ticket with bar code 25.

The card reader 31 transmits data read out from the smart card to the main CPU 41 and writes data in the smart card based on the control signal output from the main CPU 41. The key switches 33S are provided on the keypad 33 and when the keypad 33 is operated by the player, the key switches output a predetermined input signal to the main CPU 41. The data display device 32 displays data read out by the card reader 31 and data input through the keypad 33 by the player, based on the control signal output from the main CPU 41.

On the other hand, to the door PCB 80, there are connected the control panel 20, the reverter 21S, the coin counter 21C, the cold cathode ray tube 81. To the control panel 20, there are connected a spin switch 13S corresponding to the spin button 13, a change switch 14S corresponding to the change button 14, a CASHOUT switch 15S corresponding to the CASHOUT button 15, a 1-BET switch 16S corresponding to the 1-BET button 16 and a MAXBET switch 17S corresponding to the MAXBET button 17. When each of switches is operated by the player, such switch outputs an input signal to the main CPU 41.

The coin counter 21C is arranged within the coin insertion slot 21 and distinguishes whether or not the coin inserted in the insertion slot 21 by the player is true. Coins other than the true coin are discharged from the coin payout opening 23 and when the true coin is detected, the coin counter 21C outputs an input signal to the main CPU 41.

The reverter 21S operates based on the control signal output from the main CPU 41 and straddles the coins distinguished as the true coins by the coin counter 21C to a cash box (not shown) arranged in the slot machine 1 or to the hopper 66. The cold cathode ray tube 81 is arranged at the rear side of the lower image display panel 6 and the upper image display panel 27, and is turned on based on the control signal output from the main CPU 41, thereby the cold cathode ray tube 81 functions as a backlight of the display panels.

And the slot machine 1 constructed according to the above is connected to the server 100 installed in the game arcade through the communication interface 44. That is to say, one gaming system 105 is constructed from plural slot machines 1 and the server 100.

Here, the server 100 constructing the gaming system 105 will be described with reference the drawings. FIG. 4 is an explanatory view schematically showing the gaming system 105.

As shown in FIG. 4, the gaming system 105 of the first embodiment is constructed form plural slot machines (for example, five slot machines) and the server 100 conducting control of the game executed in each slot machine 1. Each slot machine 1 has construction mentioned above and is connected to the server 100 through the communication interface 44, so as to be able to realize mutual communication.

The server 100 constructing the gaming system 105 is constructed from a server CPU 101, a server ROM 102, a server RAM 103 and a server communication device 104.

The server CPU 101 is a calculation process device to execute various control programs stored in a server ROM 102 and to conduct a predetermined calculation process on the basis of such programs. And in the server ROM 102, a server control process program mentioned later is stored. Therefore, the server CPU 101 executes the server control process program stored in the server ROM 102, thereby control process concerning the lottery in which the JACKPOT accumulation sum becomes the JACKPOT payout.

The server RAM 103 is a memory device temporarily storing the calculation result when the program is executed by the server CPU 101. In the server RAM 103, a JACKPOT accumulation sum storing area 103A is formed. When the bet information is received from the slot machine 1 constructing the gaming system 105, 1% of the sum indicated by such bet information is accumulatively added in the JACKPOT accumulation sum storing area 103A. Thus, the JACKPOT accumulation sum storing area 103A is an area to store the JACKPOT accumulation sum. That is to say, the JACKPOT accumulation sum stored in the JACKPOT accumulation sum storing area 103A is paid out as the JACKPOT payout to the player who satisfies the predetermined condition in a case that the winning symbol combination of the "JACKPOT7" is won.

And the server communication device 104 is a communication device connected to the communication interface 44 of the slot machine 1 constructing the gaming system 105 so as to be able to realize mutual communication. That is to say, the server communication device 104 is utilized when the bet information, the lottery result data and the JACKPOT winning signal are transmitted to and received from the slot machine 1.

Figure 5:
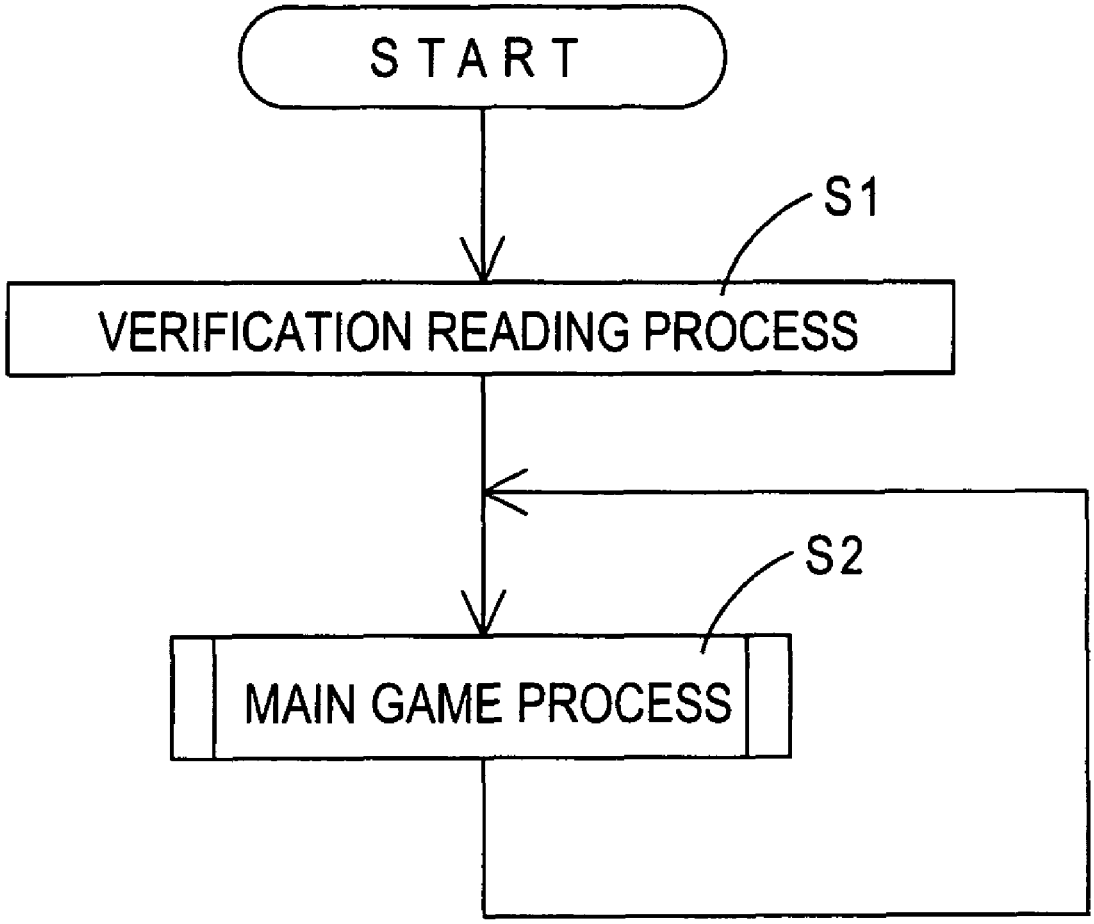
FIG. 5 is a flowchart of a main control program in the slot machine according to the first embodiment.

Next, the main control program executed in the slot machine 1 of the first embodiment will be described with reference to the drawings. FIG. 5 is a flowchart of the main control program. Here, it is supposed that the memory card 53 is inserted in the card slot 53S of the gaming board 50 and the GAL 54 is attached to the IC socket 54S.

At first, when the power switch is turned on in the power unit 45, the mother board 40 and the gaming board 50 start to operate, and the verification reading process (S1) is executed. In the verification reading process (S1), the mother board 40 and the gaming board 50 parallel conduct different process.

Namely, in the gaming board 50, the CPU 51 reads out the preliminary verifying program stored in the boot ROM 52 and conducts preliminary confirmation in which it is conducted beforehand confirmation and verification that falsification of the verifying program is not done before the verifying program is installed in the mother board 40.

On the other hand, in the mother board 40, the main CPU 41 executes the BIOS stored in the ROM 42 and develops the compressed data installed in the BIOS in the RAM 43. Thereafter, the main CPU 41 executes the BIOS developed in the RAM 43 and conducts diagnosis and initialization of various peripheral devices.

Thereafter, the main CPU 41 reads out the verifying program stored in the ROM 55 and conducts confirmation and verification that the game programs stored in the memory card 53 inserted in the card slot 53S are not falsified. After this verification process is normally terminated, the main CPU 41 writes the verified game programs in the RAM 43 and obtains the data of setting the payout rate and the country identification information.

After such process is conducted, the main CPU 41 terminates the verification reading process (S1).

And in S2, the main CPU 41 sequentially reads out and executes the game programs verified in the verification reading process (S1) and conducts the main game process. By executing the main game process (S2), the game is conducted in the slot machine 1 of the first embodiment. And the main game process (S2) is repeatedly conducted so long as power is supplied to the slot machine 1.

Figure 6:
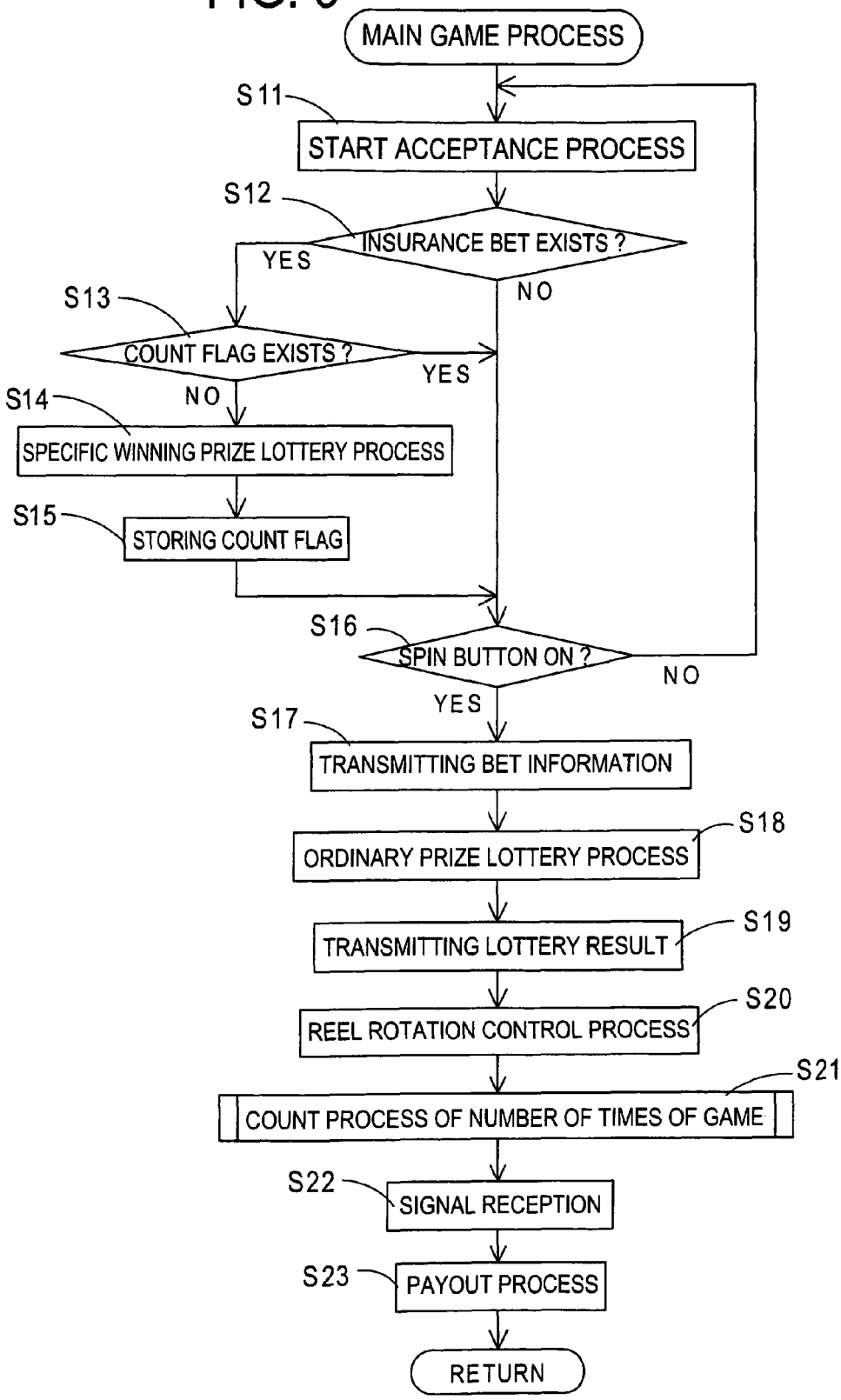
FIG. 6 is a flowchart of a game process program in the slot machine according to the first embodiment.
Figure 9:
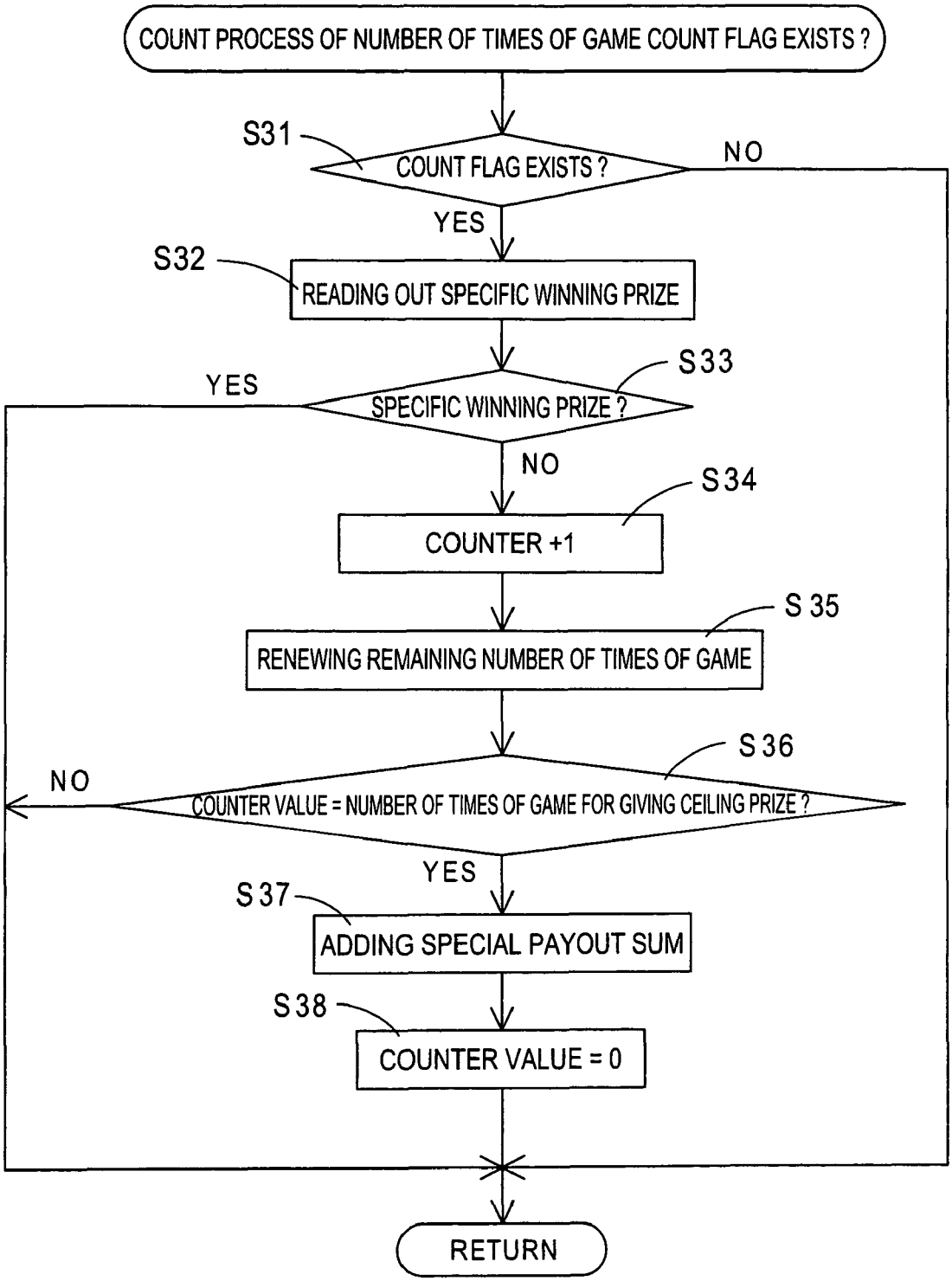
FIG. 9 is a flowchart of a count process program of a number of times of game in the slot machine according to the first embodiment.

Next, the main game process program executed in the main game process (S2) will be described with reference to FIG. 6. FIG. 6 is a flowchart of the main game process in the slot machine of the first embodiment. Here, each program shown as a flowchart in FIG. 9 and FIG. 13 is stored in the ROM 42 or the RAM 43 provided with the slot machine 1 and executed by the main CPU 41.

After the main game process (S2) is started, the main CPU 41 conducts a predetermined initialization process, thereafter conducts a start acceptance process (S11) in which the bet number corresponding to coin insertion and the pay line L is set. At that time, in the start acceptance process, coin insertion and bet operation by using the 1-BET button 16 or the MAX-BET button 17 is done by the player. And on the lower image display panel 6, an insurance BET operation portion 7 is displayed, and the player presses the insurance BET operation portion 7, thereby the insurance BET can be conducted. This insurance BET operation portion 7 is an operation portion to activate the threshold function mentioned later by paying a predetermined sum of credits (for example, one credit) as insurance money, independently the bet number (bet number betted by the 1-BET button 16 or the MAXBET button 17) usually betted in the base game.

In S12, the main CPU 41 determines whether or not the insurance BET exists. Namely, the main CPU 41 determines whether or not the insurance BET exists, based on whether or not the input signal form the touch panel 11 corresponding to the insurance BET operation portion 7 is received. If the insurance BET is conducted (S12: YES), the main CPU 41 shifts the procedure to S13. On the other hand, if the insurance BET is not conducted (S12: NO), the main CPU 41 shifts the procedure to S16.

In S13 to which the procedure shifts if the insurance BET is conducted (S12: YES), the main CPU 41 determines whether or not a counter flag is already stored in the RAM 43. Here, the count flag is a flag indicating that the threshold function is activated, and is stored based on operation of the insurance BET operation, further exists for a period till a special payout on the basis of the threshold function is given. That is to say, if the threshold flag is stored in the RAM 43, it is indicated a state that the threshold function is activated, and if the count flag does not exist, the threshold function is invalidated.

If the count flag exists in the RAM 43 and the threshold function is activated (S13: YES), the main CPU 41 shifts the procedure to S16. On the contrary, if the count flag does not exist in the RAM 43 (S13: NO), the main CPU 41 shifts the procedure to S14.

In S14, the main CPU 41 executes a specific prize lottery process to determine a specific winning prize among plural prizes (see FIG. 7), the specific winning prize being excluded from the count objects of the number of times of game.

Here, the specific winning prize lottery process (S14) will be concretely described. After the procedure shifts to the specific winning prize lottery process, the main CPU 41 executes a program for generating random numbers included in the lottery program stored in the RAM 43 and determines a random number value. And the main CPU 41 determines the prize concerned with a random number value range to which the determined random number value belongs as "specific winning prize".

As mentioned, after the specific winning prize is determined, the main CPU 41 stores such specific winning prize in the RAM 43 and shifts the procedure to S15.

Next, in S15, the main CPU 41 stores the count flag in the RAM 43. Thereby, the threshold function of the present invention is activated, and it is executed count of the number of times of game having the lottery result except for the specific winning prize. After the count flag is stored in the RAM 43, the main CPU 41 shifts the procedure to S16.

Here, at the time that the threshold function is activated, it is displayed on the upper image display panel 27 the threshold information display 27A (see FIG. 10) to inform the information (for example, number of times of game) concerning giving of the special payout (so-called, threshold prize).

In S16, the main CPU 41 determines whether or not the spin button is pressed. It is determined whether or not the spin button 13 is pressed, based on whether or not the input signal from the spin switch 13 is received.

If the spin button 13 is not pressed (S16: NO), the procedure again returns to the start acceptance process (S11). At that time, correction of the bet number and operation of the insurance BET can be done. On the other hand, if the spin button 13 is pressed (S16: YES), the bet number set for the pay line L based on operation of the 1-BET button 16 or the MAXBET button 17 and the credit according to the insurance BET are reduced from the credit number held by the player, and the bet number set for the pay line L is stored as the bet information in the RAM 43.

Next, in S17, the main CPU 41 reads out the bet information from the RAM 43 and transmits it to the server 100 through the communication interface 44. Here, the bet information transmitted from the slot machine 1 is utilized when the JACKPOT accumulation sum is calculated in the server 100. This operation will be described in detail hereinafter.

After the bet information is transmitted to the server 100, the main CPU 41 shifts the procedure to S18.

In S18, the main CPU 41 executes a normal prize lottery process. Concretely, the main CPU 41 executes the program for generating the random numbers included in the lottery program stored in the RAM 43, thereby selects the random number values respectively corresponding to three reels 5L, 5C, 5R within a value range of 0~255. And referring the data for weighing symbol corresponding to the data for setting the payout rate, the code Nos. (see FIG. 2) of the reels 5L, 5C, 5R are determined based on three random number values selected. The code Nos. of the reels 5L, 5C, 5R determined are stored in the RAM 43, thereafter the procedure shifts to S19.

Here, the code No. of each reel 5L, 5C, 5R is corresponded to the code No. of the symbol stopped and displayed on the pay line L, therefore the main CPU 41 determines the code No. of each reel 5L, 5C, 5R, thereby the prize in the game is determined. For example, if the code Nos. of the reels 5L, 5C, 5R are respectively determined to "00", "00", "00", it concludes that the prize is determined as "JACKPOT7". As mentioned in the above, by determining the code No. of each reel 5L, 5C, 5R, the lottery for the normal prize (see FIG. 7) is conducted.

Here, in the first embodiment, it is described one example in which the symbol combination stopped and displayed is determined, thereby one prize is determined among plural kinds of normal prizes. However, for example, it may be conceivable that one prize is first selected among plural kinds of normal prizes by the lottery, thereafter the symbol combination stopped and displayed is determined based on the above prize.

Here, the normal prizes and payouts thereof will be described with reference to FIG. 7, in a case that the game using the reels 5L, 5C, 5R is conducted in the slot machine 1. FIG. 7 is a table showing winning prizes, winning probability of each winning prize and payouts thereof in a case that the game using the reels 5L, 5C, 5R is conducted.

Here, the payout shown in FIG. 7 indicates the payout when the bet number is "1". Therefore, if the bet number is "1", the payout sum shown in FIG. 7 is paid out. However, if the bet number is more than "2", the payout calculated by multiplying the payout value shown in FIG. 7 with the bet number is done as the payout sum.

And the winning of each prize shown in FIG. 7 shows a case that the payout rate is 88%. Here, the winning probability in FIG. 7 indicates a probability according to which the prize is realized in a case that the code No. of each reel 5L, 5C, 5R is determined based on three random number values while referring the data for weighing symbol. That is to say, the random number is not corresponded to each prize.

For example, as shown in FIG. 7, the winning probability to win "JACKPOT" is 0.5%. If the prize "JACKPOT" is won, three symbols of "JACKPOT 7" are stopped and displayed on the pay line L and the JACKPOT accumulation sum stored in the JACKPOT accumulation sum storing area 103A is paid out as the payout.

Hereinafter, similarly to the above, the winning probability and the payout thereof are set every symbol combination shown in FIG. 7. However, if the symbol combination other than any of the symbol combinations shown in FIG. 7 is stopped and displayed, the game result is loss of winning and the payout sum on the basis of the normal prize is not given.

Again returning to FIG. 6, the main game process (S2) will be described. After the normal prize lottery process (S18) is terminated, if the procedure shifts to S19, the main CPU 41 transmits the lottery result data indicating the lottery result in the normal prize lottery process (S19) to the server 100 through the communication interface 44. This lottery result data are utilized in the server control process program mentioned later. This operation will be described in detail hereinafter.

After the lottery result data are transmitted to the server 100, the main CPU 41 shifts the procedure to S20.

Next, in S20, the main CPU 41 conducts a reel rotation control process. The reel rotation control process is a process to stop rotation of the reels 5L, 5C, 5R. so that the symbol combination determined in the normal prize lottery process (S18) is stopped and displayed on the pay line L after all reels 5L, 5C, 5R start to rotate. Here, this process is a process conducted between the main CPU 41 and the sub-CPU 61.

Concretely speaking, in the reel rotation control process (S20), at first, the main CPU 41 transmits the start signal to start rotation of the reels to the sub-CPU 61. After receiving the start signal, the sub-CPU 61 drives each of the stepping motors 70L, 70C, 70R through the motor drive circuit 62 and the driver 64 and starts rotation of the reels 5L, 5C, 5R.

And after transmission of the start signal, the main CPU 41 determines effect modes (image display mode on the lower image display panel 6 and sound output mode of sounds output from the speaker 28) and start the effect according to the effect modes determined according to the above.

Thereafter, when the predetermined stop timing to stop rotation of the reels 5L, 5C, 5R has come, the main CPU 41 executes a reel stop process based on the code Nos. of the reels. Thereby, the symbols corresponding to the lottery result are stopped and displayed on the pay line L of the display windows 10L, 10C, 10R.

And in S21, the main CPU 41 executes a count process of number of times of game. Although this count process of number of times of game will be described in detail with reference to the drawings hereinafter, such process will be simply described here. If the count flag is stored in the RAM 43, the main CPU 41 counts the number of times of game in which the lottery result becomes the prize other than the specific winning prize. Here, as a result that the number of times of game is counted, in a case that the number of times of game reaches to the number of times of game for giving the special payout (for example, 600 games), the special payout is added as the payout sum. On the other hand, if the number of times of game does not reach to the number of times of game for giving the special payout, the procedure shifts to S22.

Here, if the count flag is not stored in the RAM 43 and the threshold function is in the invalidated state, the main CPU 41 does not conduct count of the number of times of game and shifts the procedure to S22.

When the procedure shifts to S22, the main CPU 41 executes a signal reception process in which the signal transmitted from the server 100 through the communication interface 44 is received.

Here, in the first embodiment, the signal transmitted from the server 100 is the JACKPOT winning signal. This JACKPOT winning signal is the signal which is transmitted to the slot machine 1 which wins the prize of JACKPOT, when the prize of JACKPOT is won in the normal prize lottery process (S18) or the prize of JACKPOT is won in a JACKPOT lottery process (S102) conducted in the server 100. Therefore, the slot machine 1 corresponding to any of the above two conditions receives the JACKPOT winning signal, in order to give the JACKPOT accumulation sum stored in the JACKPOT accumulation sum storing area 103A at the time of winning as the payout to the player. After receiving the JACKPOT winning signal and storing the JACKPOT accumulation sum as the payout sum in the RAM 43, the JACKPOT accumulation sum becoming the payout sum included in the JACKPOT winning signal, the main CPU 41 shifts the procedure to S18.

Here, the slot machine not corresponding to any of the above two conditions dose not receive the JACKPOT winning signal and the procedure shifts to S23.

In S23, the main CPU 41 confirms the sum at the time that the procedure shifts to S23 as the payout sum, and conducts a payout process of the payout sum. Here, the sum at the time that the procedure shifts to S23 is the total sum calculated by adding the sum according to the winning prize which is won in the ordinary prize lottery process (S18), the JACKPOT accumulation sum when the JACKPOT winning signal is received and the special payout sum given when the threshold function is activated and the number of times of game corresponding to the number of times of game for giving the threshold prize is counted. Here, for example, if the ordinary prize is lost, the payout sum of the ordinary prize is, of course, made "0" and the total sum of the other payouts are paid out.

Here, in the payout process (S23), based on that the CASH-OUT button 15 is pressed, the total sum may be paid out as coins corresponding to the credit number (one credit corresponds to one coin) and the total sum may be paid out by the ticket with bar code 25.

Figure 8:
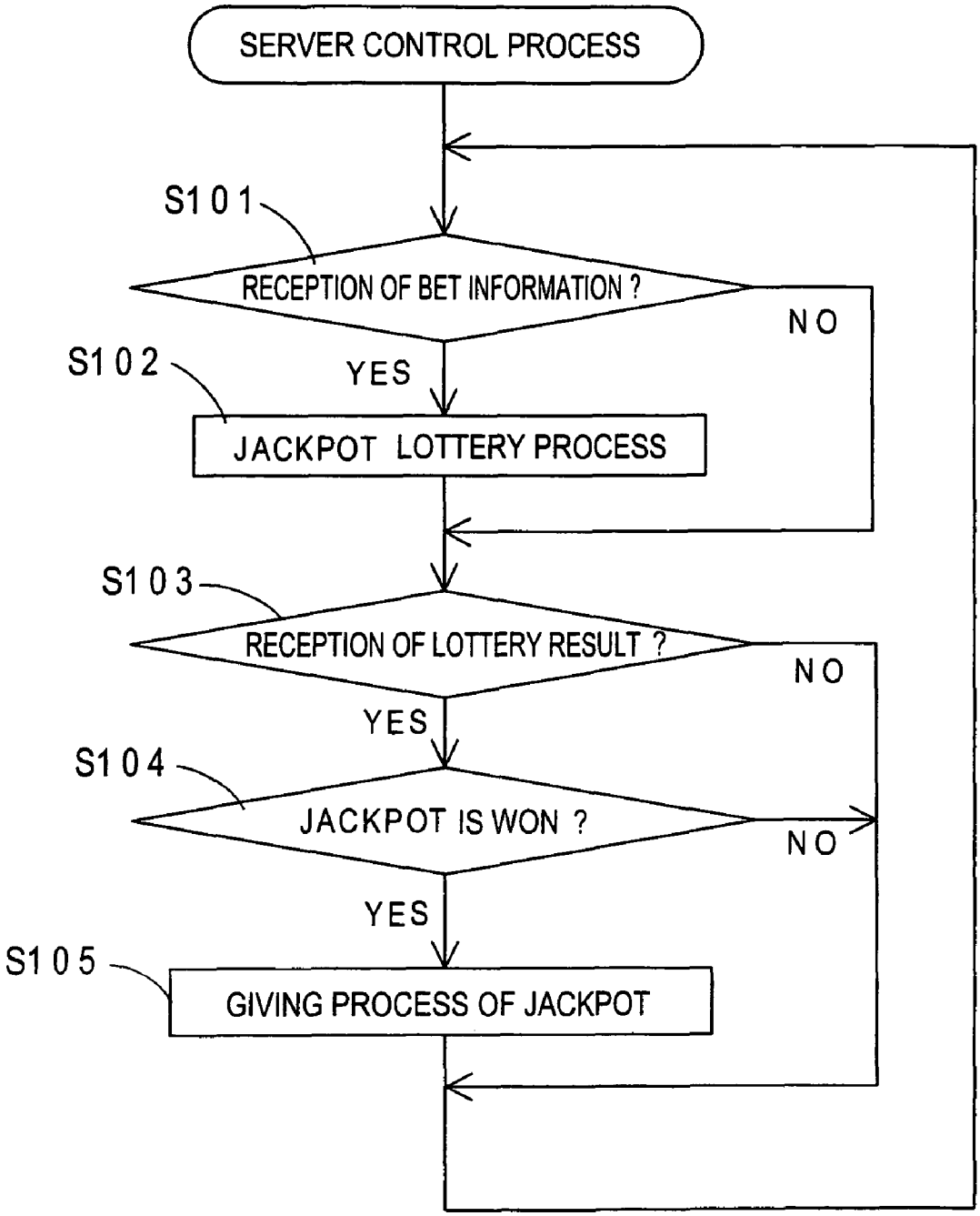
FIG. 8 is a flowchart of a server control process program of a server according to the first embodiment.

Next, the server control process program of the server 100 constructing the gaming system 105 of the first embodiment will be described with reference to the drawings. FIG. 8 is a flowchart of the server control process program.

As shown in FIG. 8, after the server control process program is started, the server CPU 101 determines in S101 whether or not the bet information is received from the slot machine 1 constructing the gaming system 105.

As mentioned above, after the start acceptance process (S11) is terminated and the spin button 13 is pressed, the slot machine 1 transmits the bet information in the present game (S16). That is to say, in S101, it is determined whether or not the bet information transmitted from the slot machine 1 in S16 is received. If the bet information is received (S101: YES), a predetermined rate of sum (for example, 1% of sum) indicated by the received bet information is added to the accumulation sum of the JACKPOT accumulation sum storing area 103A, and it is executed the JACKPOT lottery process (S102) in which it is determined by the lottery whether or not the JACKPOT accumulation sum is given as the payout sum. On the other hand, if the bet information is not received (S101: NO), the procedure shifts to S103.

In S102, the server CPU 101 adds the sum corresponding to the predetermined rate of the received bet information to the JACKPOT accumulation sum, thereafter executes the program for generating the random numbers stored in the server ROM 102, thereby selects one random number value from a value range of 0~511. And based on the lottery table stored in the server ROM 102, the server CPU 101 determines the lottery result in the JACKPOT lottery. After storing the lottery result in the JACKPOT lottery process (S102) in the RAM 43, the server CPU 101 shifts the procedure to S103.

Concretely, if the random number value "0" or "1" is selected according to the program for generating the random numbers, the JACKPOT is won in the JACKPOT lottery process (S102) and the JACKPOT accumulation sum is given to the slot machine 1 as the payout. On the other hand, if the other random number value is selected, the JACKPOT is lost in the JACKPOT lottery process (S102). The winning probability of the JACKPOT lottery process (S102) is about 0.4%.

And in S103, the server CPU 101 determines whether or not the lottery result data of the ordinary prize are received from the slot machine 1. If the lottery result data are not received (S103: NO), the procedure returns to S101. On the other hand, if the lottery result data are received (S103: YES), the server CPU 101 shifts the procedure to S104.

In S104, the server CPU 101 determines whether or not the JACKPOT, according to which the JACKPOT accumulation sum is given as the payout, is won. Here, as for the case that the JACKPOT is won, there exist two cases, one of which is the case that the prize of "JACKPOT" is won in the ordinary prize lottery process (S18) in the slot machine 1 and another of which is the case that the JACKPOT is won in the JACKPOT lottery process (S102) in the server 100.

In a case that any of the two cases is realized, thereby the JACKPOT is won (S104: YES), the server CPU 101 reads out the JACKPOT accumulation sum from the JACKPOT accumulation sum storing area 103A and transmits the winning signal indicating the JACKPOT accumulation sum and winning of the JACKPOT to the slot machine 1 in which the JACKPOT is won (S105). And after transmitting the JACKPOT winning signal, the server CPU 101 resets the JACKPOT accumulation sum stored in the JACKPOT accumulation sum storing area 103A to "0". After resetting the JACKPOT accumulation sum in the JACKPOT accumulation sum storing area 103A, the server CPU 101 returns the procedure to S101.

On the other hand, if the JACKPOT is not won (S104: NO), the server CPU 101 returns the procedure to S101.

As mentioned, in the gaming system 105 of the first embodiment, every the game is conducted in the slot machine 1 constructing the gaming system 105, a predetermined rate of the sum corresponding to the bet number utilized in the slot machine 1 is accumulatively added as the JACKPOT accumulation sum in the JACKPOT accumulation sum storing area 103A and such JACKPOT accumulation sum is given as the payout to the player who wins the JACKPOT. That is to say, large expectation for high payout can be given to the player. And since the player can get high payout if any of the prize of "JACKPOT7" in the normal prize lottery process (S18) and the JACKPOT in the JACKPOT lottery process (S102) is won, further large expectation can be given to the player.

Next, the count process program of the number of times of game executed in the count process of the number of times of game (S21) in the main game process (S2) of the slot machine 1 will be described with reference to the drawings. FIG. 9 is a flowchart of the count process program of the number of times of game.

As shown in FIG. 9, after the procedure shifts to the count process of the number of times of game (S21), the main CPU 41 determines whether or not the count flag exists in the RAM 43 (S31). If the count flag does not exist in the RAM 43 and the threshold function is not activated (S31: NO), the main CPU 41 terminates the count process of the number of times of game (S21).

On the other hand, if the count flag exists in the RAM 43 and the threshold function is activated (S31: YES), the main CPU 41 shifts the procedure to S32 and reads out the specific winning prize determined in the specific winning prize lottery process (S14) from the RAM 43.

In S33, the main CPU 41 determines whether or not the lottery result of the ordinary prize lottery process (S18) corresponds to the specific winning prize. If the lottery result corresponds to the specific winning prize (S33: YES), the main CPU 41 terminates the count process of the number of times of game. On the other hand if the lottery result of the ordinary prize lottery process (S18) does not correspond to the specific winning prize (S33: NO), a value in the counter for counting the number of times of game formed in the RAM 43 is incremented by "1", thereafter such value is again stored in the RAM 43 (S34).

Next, in S35, based on the value in the counter for counting the number of times of game and the number of times of game (600 games) for giving the threshold prize, a remaining number of times of game necessary to obtain the special payout (threshold prize) is calculated and such remaining number of times of game is renewed. That is to say, the main CPU 41 calculates the difference between the number of times of game for giving the threshold prize and the value of the counter for counting the number of times of game, and stores the difference as the remaining number of times of game. After renewing the remaining number of times of game, the main CPU 41 shifts the procedure to S36.

Figure 10:
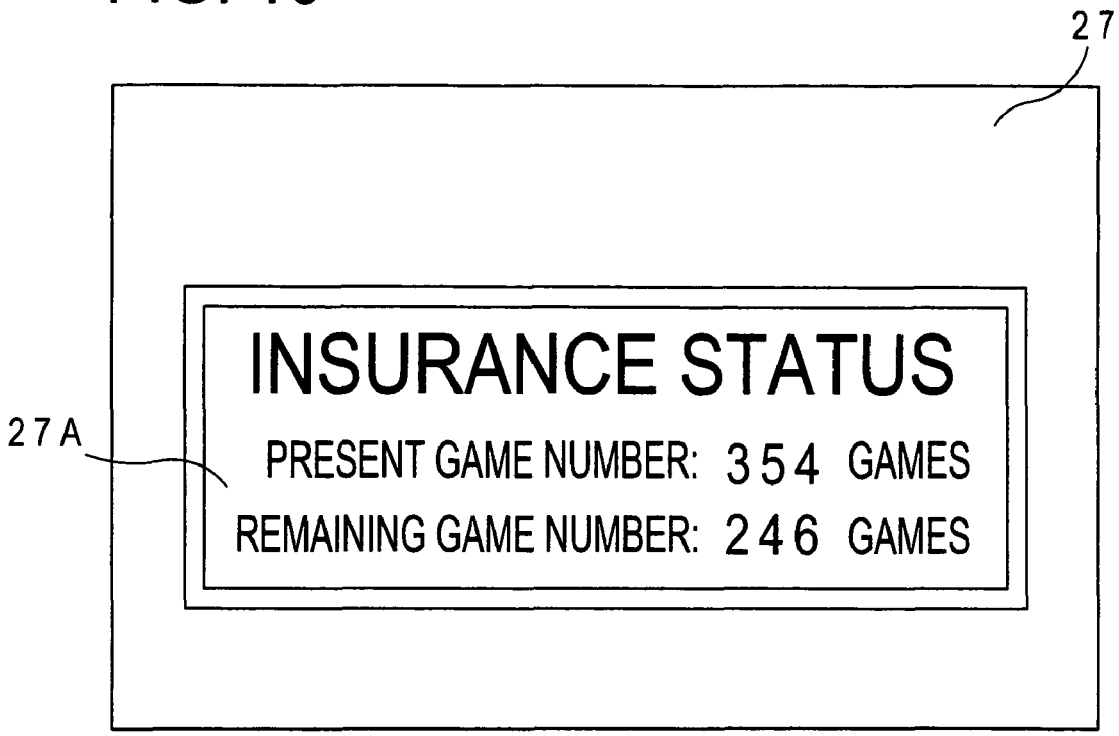
FIG. 10 is an explanatory view showing threshold information displayed on an upper image display panel.

Here, as mentioned, if the threshold function is activated, since the threshold information display 27A is conducted in the upper image display panel 27, contents of the threshold information display 27A are renewed based on that the remaining number of times of game is renewed Namely, as shown in FIG. 10, although the present game number corresponding to the value of the counter for counting the number of times of game and the remaining game number corresponding to the remaining number of times of game are displayed in the upper image display panel 27, the present game number is added by "1" and the remaining game number is reduced by "1" based on the data of the remaining number of times of game are renewed.

Next, in S36, the main CPU 41 determines whether or not the value of the counter for counting the number of times of game reaches to the number of times of game for giving the threshold prize. If the value of the counter for counting the number of times of game reaches to the number of times of game for giving the threshold prize (S36: YES), the special payout (500 credits) is added to the present sum (S37). And after the special payout is added to the present sum, the value of the counter for counting the number of times of game is reset to "0" and the count process of the number of times of game (S21) is terminated. On the other hand, the value of the counter for counting the number of times of game does not reach to the number of times of game for giving the threshold prize (S36: NO), the main CPU 41 terminates the count process for counting the number of times of game (S21).

As mentioned in the above, in the slot machine 1 and the gaming system 105, it is determined whether or not the special payout is given, based on the lottery result of the normal prize lottery process (S18) in the slot machine 1 and the result in the specific winning prize lottery process (S14). That is to say, if the lottery result of the normal prize lottery process (S18) does not correspond to the specific winning prize, such game is counted by the counter for counting the number of times of game. And only if the value of the counter for counting the number of times of game reaches to the number of times of game for giving the threshold prize, the special payout is given to the player.

As the result of the specific winning prize lottery process (S14), it is determined the winning prize which is out of the object counted by the counter for counting the number of times of game, therefore at the same time the winning prize which is the object counted by the counter for counting the number of times of game is changed. Thereby, it becomes hard for the player to grasp the winning prize that the number of times of game is counted. Thus, even if the player knows the number of times of game for giving the threshold prize based on which the special payout is given, it becomes hard to grasp when such number of times of game is counted. Namely, even if the player can grasp that the special payout is immediately given, the player cannot concretely grasp the time that the special payout is actually given, therefore the player can sufficiently enjoy expectation and strain based on that the special payout is immediately given.

Further, since the player cannot grasp the winning prize which is the object counted by the counter for counting the number of times of game, it concludes that the special payout is suddenly given to the player. That is to say, interest of surprise and delight that the special payout is given can be provided to the player who knows the number of times of game for giving the threshold prize.

Second Embodiment

Next, the second embodiment which is another embodiment different from the first embodiment will be described with reference to the drawings. Here, in the explanation of the second embodiment, the same elements as in the first embodiment will be described by using the same numbers in the first embodiment.

The basic construction of the slot machine 1 and the gaming system 105 in the second embodiment is same as that of the first embodiment. And in the gaming system 105 of the second embodiment, similarly to the first embodiment, a plurality of slot machines 1 and the server 100 are connected so as to communicate with each other and the gaming system 105 has the JACKPOT function and the threshold function. As for these points, since they are explained in the first embodiment, explanation thereof will be omitted.

In the slot machine 1, the server 100 and the gaming system 105 of the second embodiment, the control program executed by the slot machine 1 and the server 100 of the second embodiment is different from the first embodiment. Therefore, hereinafter the control program of the slot machine 1 in the second embodiment, different from that of the first embodiment, and control program of the server 100 will be described with reference to the drawings.

Figure 11:
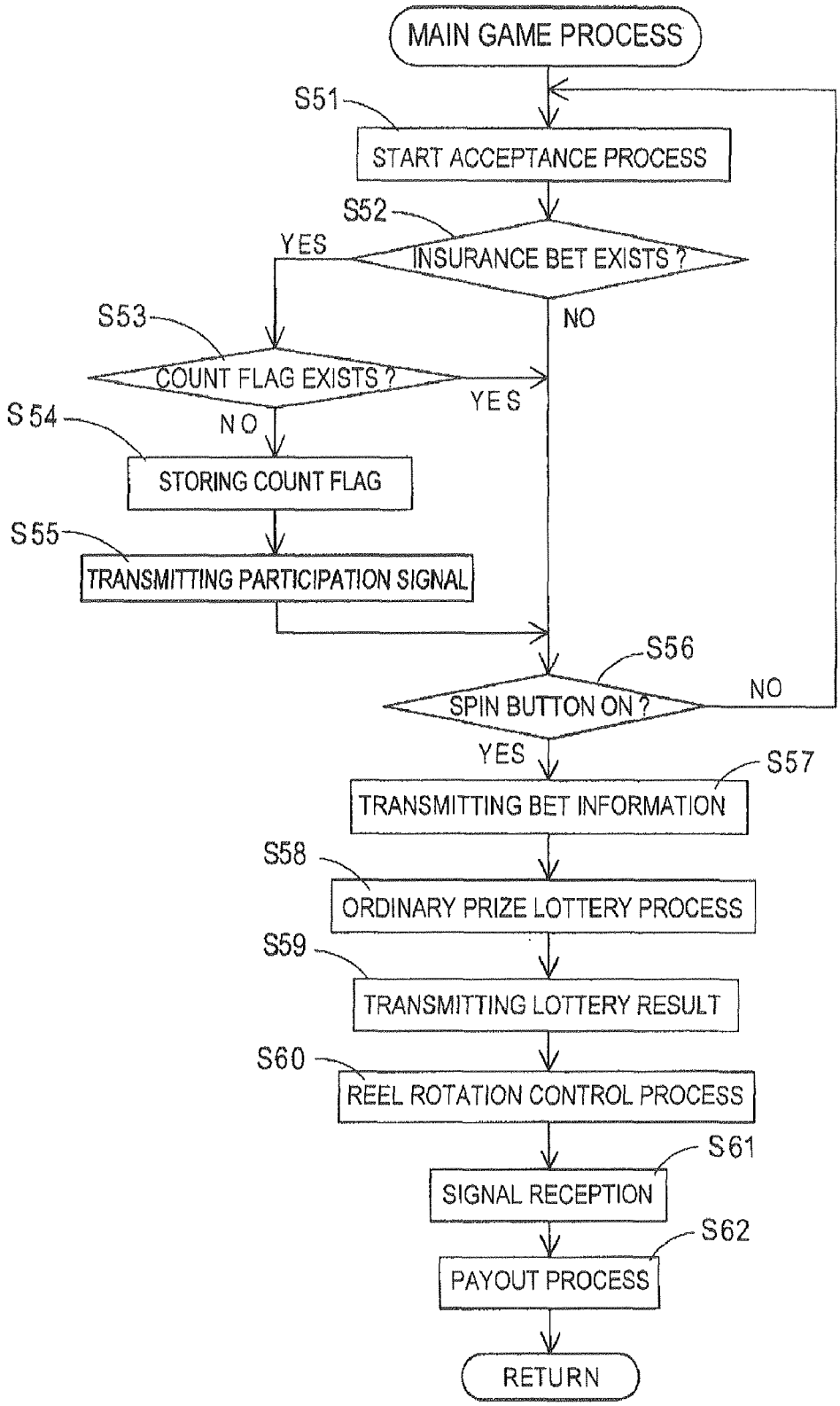
FIG. 11 is a main game process program in the slot machine according to the second embodiment.

At first, the main game process program executed in the main game process (S2) of the slot machine 1 in the second embodiment will be described in detail with reference to the drawings. FIG. 11 is a flowchart of the main game process program of the slot machine 1 in the second embodiment.

As shown in FIG. 11, after execution of the main game process program is started, the start acceptance process (S51) is conducted, thereafter the determination process (S52) whether or not the insurance BET exists is conducted. If the insurance BET exists (S52: YES), the determination process (S53) whether or not the count flag exists. And if the count flag is not stored in the RAM 43 (S53: NO), it is conducted the process to store the count flag in the RAM 43 (S54). That is to say, similar to the processes of S11 to S13, S15 in the first embodiment, the processes of S51 to S54 are conducted.

Here, in the second embodiment, after the count flag is stored in the RAM 43 (S54), it is transmitted to the server 100 a participation signal indicating that the slot machine 1 participates in the game in which the threshold function is activated based on the count flag stored in the RAM 43. After the participation signal is transmitted to the server 100, the main CPU 41 shifts the procedure to S56, and determines whether or not the spin button 13 is pressed.

And when the spin button 13 is pressed (S56: YES), as shown in FIG. 11, transmission of the bet information to the server 100 (S57), the ordinary prize lottery process (S58), the transmission of the lottery result data to the server 100 (S59) the reel rotation control process (S60), the signal reception process (S61) and the payout process (S62) are sequentially conducted.

The processes of S56 to S62 correspond to the processes of S17 to S20, S22, S23, and since explanation thereof is already done in the first embodiment, explanation thereof will be omitted.

Here, in the signal reception process (S61), reception of the special payout giving signal transmitted in the special payout giving process (S161) executed in the server 100 and reception of the data of the remaining number of times of game transmitted in S162 are also conducted. Thereby, in the payout process (S62), the special payout is also added to the payout sum and paid out and the information of the threshold information display 27A (See FIG. 10) is renewed.

Figure 12:
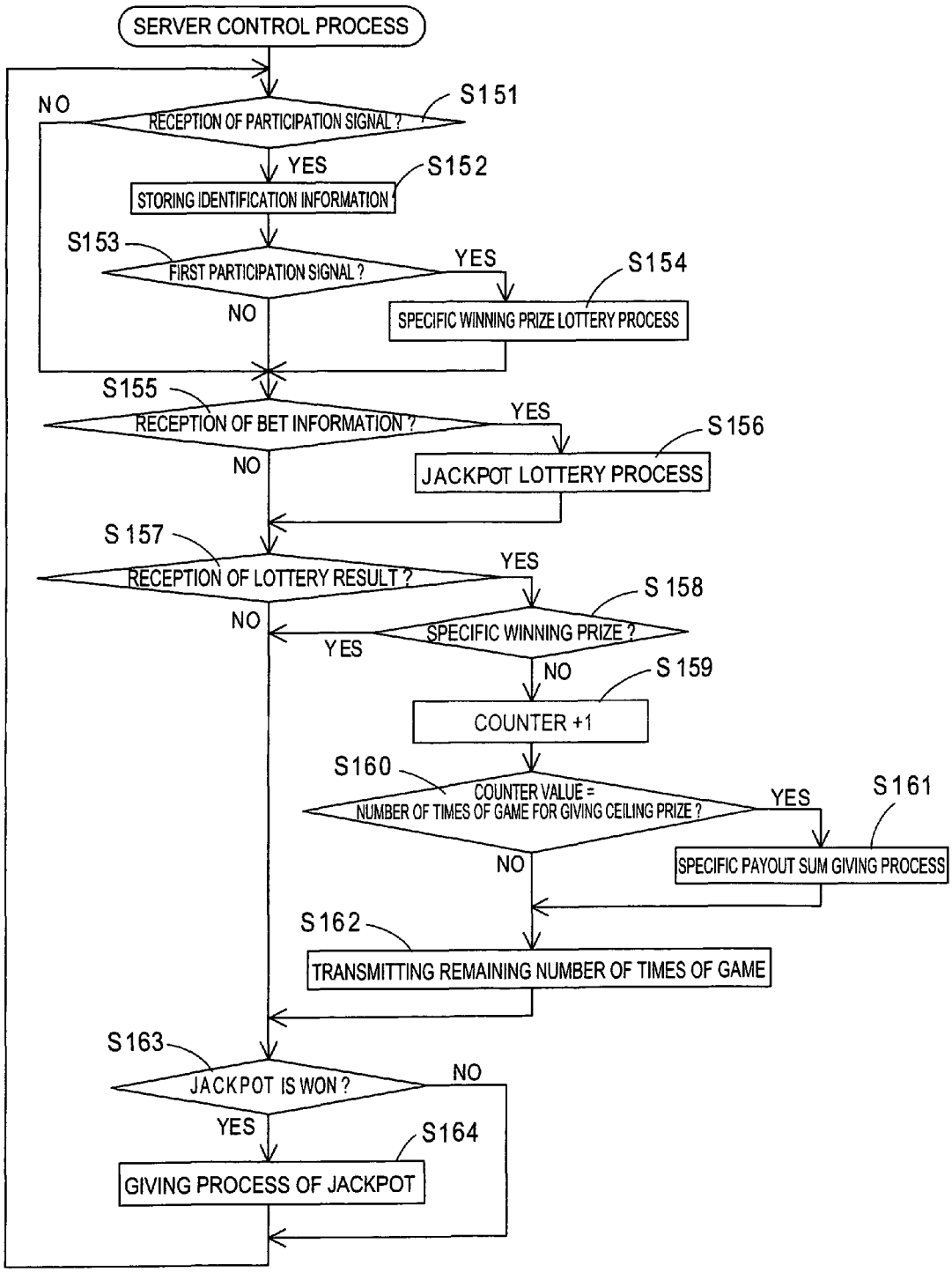
FIG. 12 is a flowchart of a server control process program of a server according to the second embodiment.

Next, the server control process program executed in the server 100 of the second embodiment will be described with reference to the drawings. FIG. 12 is a flowchart of the server control program according to the second embodiment.

After the server control process program is executed, at first, the server CPU 101 determines whether or not the participation signal is received through the server communication device 104 (S151). If the participation signal is received (S151: YES), the identification signal to specify the slot machine 1 transmitting the participation signal, the identification signal being included in the participation signal, is stored in the RAM 43 (S152). After storing the identification signal in the RAM 43, the server CPU 101 shifts the procedure to S153. On the other hand, if the participation signal is not received (S151: N), the server CPU 101 shifts the procedure to S155.

In S153, the server CPU 101 determines whether or not the received participation signal is the first participation signal. That is to say, the server CPU 101 conducts such determination based on whether or not the identification signal stored in the server RAM 103 is one. If such participation signal is the first participation signal (S153: YES), the server CPU 101 executes the specific winning prize lottery process (S154). This specific winning prize lottery process (S154) is the same process as the specific winning prize lottery process (S14) in the first embodiment and explanation thereof is already conducted, therefore explanation thereof will be omitted. Based on the lottery result of the specific winning prize lottery process (S154), the specific winning prize is determined, thereafter the server CPU 101 stores such specific winning prize in the server RAM 103 and shifts the procedure to S155.

On the other hand, if such participation signal is not the first participation signal (S153: NO), the sever CPU 101 shifts the procedure to S155.

In S155, the server CPU 101 determines whether or not the bet information is received. If the bet information is received (S155: YES), the JACKPOT lottery process (S156) is executed. In the JACKPOT lottery process (S156), addition of the JACKPOT accumulation sum and the lottery concerning winning of the JACKPOT are executed based on the bet information. After terminating the JACKPOT lottery process, the server CPU 101 shifts the procedure to S157. On the other hand, if the bet information is not received (S55: NO), the server CPU 101 shifts the procedure to S157.

After the procedure shifts to S157, the server CPU 101 determines whether or not the lottery result data of the ordinary prize lottery process (S58) are received. If the lottery result data are not received (S157: NO), the server CPU 101 shifts the procedure to S163.

On the other hand, if the lottery result data are received (S157: YES), the server CPU 101 determines whether or not the winning prize indicated by the lottery result data is the specific winning prize (S158). If the lottery result corresponds to the specific winning prize (S158: YES), the server CPU 101 shifts the procedure to S163. On the other hand, if the lottery result does not correspond to the specific winning prize (S158: NO), "1" is added to the value of the counter for counting the number of times of game formed in the server RAM 103 (S159). After adding "1" to the value of the counter for counting the number of times of game, the server CPU 101 shifts the procedure to S160.

In S160, the server CPU 101 determines whether or not the value of the counter for counting the number of times of game reaches to the number of times of game (for example, 600 games) for giving the threshold prize. If the value of the counter for counting the number of times of game reaches to the number of times of game for giving the threshold prize (S160: YES), the server CPU 101 shifts the procedure to S161. On the other hand, if the value of the counter for counting the number of times of game does not reach to the number of times of game for giving the threshold prize (S160: NO), the procedure shifts to S162.

In S161 to which the procedure shifts in a case that the value of the counter for counting the number of times of game reaches to the number of times of game for giving the threshold prize, the special payout giving process to give the special payout to the player who is playing in the slot machine 1 that games are conducted till the number of times of game reaches to the number of times of game for giving the threshold prize. Concretely, the server CPU 101 determines whether or not it is stored in the server RAM 103 the identification information indicating the slot machine 1 in which games are conducted till the number of times of game reaches to the number of times of game for giving the threshold prize. If the identification information is stored in the server RAM 103, the server CPU 101 specifies the slot machine 1 on the basis of the identification information and transmits the special payout giving signal to the slot machine 1. After transmitting the special payout giving signal, the server CPU 101 shifts the procedure to S162. On the other hand, if it is not stored the identification information indicating the slot machine 1 in which games are conducted till the number of times of game reaches to the number of times of game for giving the threshold prize, the procedure shifts to S162

Here, when the process shifts from the special payout giving process (S161) to S162, the server CPU 101 erases all identification information stored in the server RAM 103 and resets the value of the counter to "0".

In S162, the server CPU 101 transmits the data of remaining number of times of game to each of the slot machines 1. At that time, if the value of the counter for counting the number of times of game does not reach to the number of times of game for giving the threshold prize, it is transmitted the data of number of times of game to which "1" is added in S159. And in a case that the procedure shifts to S162 after the special payout giving process (161) is conducted, the value of the counter is reset to "0" in the special payout giving process (S161), therefore the data of remaining number of times of game indicating the remaining number of times of game ("600 games") are transmitted. Thereby, the information displayed in the threshold information display 27A (see FIG. 10) is renewed to the latest information.

After transmitting the latest remaining number of times of game, the server CPU 101 shifts the procedure to S163.

In S163, the server CPU 101 determines whether or not the JACKPOT is won. In a case that the prize of "JACKPOT7" is won in the ordinary prize lottery process (S58) or the JACKPOT is won in the JACKPOT lottery process (S156) (S163: YES), the server CPU 101 shifts the procedure to the JACKPOT payout giving process (164). Concretely, the JACKPOT accumulation sum is read out from the JACKPOT accumulation sum storing area 103A, and such read out sum and the JACKPOT winning signal indicating the winning of the JACKPOT are transmitted to the slot machine 1 in which the JACKPOT is won. After transmitting the JACKPOT winning signal, the server CPU 101 returns the procedure to S151.

Thereby, the JACKPOT winning signal is received in the signal reception process (S61) in the slot machine 1 and the JACKPOT accumulation sum is added as the payout sum. That is to say, the JACKPOT accumulation sum is paid out in the payout process (S62).

On the other hand, if the JACKPOT is not won (S163: NO), the server CPU 101 returns the procedure to S151.

As mentioned above, in the gaming system 105 of the second embodiment, the process according to the threshold function is conducted in the server 100. Namely, the specific winning prize lottery process (S154), count of the counter for counting the number of times of game on the basis of the lottery result and specific winning prize (S157 to S159) and giving of the special payout sum (S160 to S162) are wholly conducted in the server 100.

Here, in the first embodiment, although count by the counter for counting the number of times of game is conducted every slot machine 1, count by the counter for counting the number of times of game is conducted in the server 100. That is to say, it is conducted count of the number of times of game based on reception of the lottery result data of all slot machines 1 constructing the gaming system 105, therefore the number of times of game will easily reach to the number of times of game for giving the threshold prize for a shorter period. Thereby, it can be provided the slot machine 1 and the gaming system 105 with attractive threshold function.

As mentioned, in the slot machine 1 and the gaming system 105, one winning prize is determined among plural winning prizes by the specific winning prize lottery process (14, S154) and the number of times of game is counted by the counter for counting the number of times of game in a case that the lottery result of the ordinary prize lottery process (S18, S58) corresponds to the winning prize other than the specific winning prize. And based on that the count result of the counter reaches to the number of times of game for giving the threshold prize (600 games), the special payout (500 credits) is given.

That is to say, since the winning prize, which becomes out of the object counted, is determined in the specific winning prize lottery process (S14, S154), it becomes difficult for the player to grasp whether or not the number of times of game is counted based on which winning prize is won. Therefore, it becomes difficult to correctly grasp the time that the special payout is given, as a result, the player can enjoy surprise and delight when the special payout is given.

And on the upper image display panel 27, the threshold information display 27A is conducted, and there are displayed the present game number of times and the remaining game number of times till the number of times of game reaches to the number of times of game for giving the threshold prize. Thereby, the player can grasp the state till the special payout is given. And since the player can grasp the time that the special payout is immediately given, expectation for giving the special payout can be increased.

At that time, since it becomes difficult to correctly grasp the time that the special payout is given on the basis of the specific winning prize lottery process (S14, S154), the player can retain for a long period the state that he/she has strong expectation for giving the special payout, thus when the special payout is given, the player can enjoy interest of large surprise and delight.

Here, the present invention is not limited to the embodiments. Various changes and modifications may be, of course, done within the scope of the present invention.

For example, in the embodiments, although the special payout is 500 credits, such special payout is not limited to this. For example, the sum of credit may be increased or decreased, and the bonus game may be given as the special payout and gifts may be given as the special payout.

In the embodiments, although the threshold function is activated by operating the insurance BET operation portion 7, the present invention is not limited to the above operation. For example, the threshold function may be activated when plural operation members (for example, spin button 13 and 1-BET button 16) are simultaneously operated.

Further, in the embodiments, although the threshold function retains activated state from operation of the insurance BET operation portion 7 to giving of the special payout and count by the counter for counting the number of times of game is conducted, the present invention is not limited to this construction. For example, in the payout process (S23, S62), the value of the counter for counting the number of times of game may be reset at the time that the credit held by the player becomes "0" and count by the counter may be conducted every player.

And in the embodiments, although the specific winning prize lottery process (S14, S154) is executed linking with giving of the special payout, the specific winning prize lottery process (S14, S154) may be executed linking with reset of the counter. Here, in a case that the value of the counter is reset every player, the specific winning prize lottery process is conducted every player, therefore count mode of times of game becomes different every player.

In the embodiments, although the specific winning prize is determined by the lottery in the specific winning prize lottery process (S14, S154), the present invention is not limited to this. For example, the manager (for example, shop keeper of the game arcade) of the slot machine 1 and the gaming system 105 may voluntarily select and set the specific winning prize. In this case, the period till the special payout is given is changed according to the winning probability of the prize, therefore benefit of the game arcade can be adjusted according to the set of specific winning prize.

And the specific winning prize is not limited to one winning prize, and plural specific winning prizes may be determined. For example, if all prizes are set to the specific winning prize, the number of times of game (so-called, loss game) that no payout is given to the player is counted. That is to say, when the number of times of loss game with no payout reaches to a predetermined number of times, the special payout may be given. Further, in the embodiments, although the specific winning prize is determined among the winning prizes, the lottery result in which the winning prize is not obtained and no payout is given may be handled as "loss of game" and this may be set to the specific winning prize.

And in the embodiments, as shown in FIG. 10, although the threshold information display 27A is conducted on the upper image display panel 27 and the present game number of times and the remaining game number of times till the number of times of game reaches to the number of times of game for giving the threshold prize are displayed on the upper image display panel 27, the remaining game number of times may be displayed with the effect. For example, in a case that the remaining game number of times reduces, only "remaining game number of times" may be largely displayed on the upper image display panel 27 and "count down display" may be conducted with the effect of display and effect sounds to inform with the player. By conducting such effect, expectation of the player concerning the special payout can be increased.

And the size of the gaming system 105 is not limited to that in the game arcade. For example, the gaming system 105 can be constructed from the slot machines 1 and the server 100 which are installed in plural game arcades within some area.

What is claimed is:

1. A gaming machine comprising:

a display device; and a processor which is programmed to execute steps (a) to (f) below for controlling a game displayed on the display device:

(a) determining an outcome among plural outcomes by a lottery;

(b) displaying the outcome on the display device;

(c) giving a prize based on the outcome when the outcome is a prize winning outcome;

(d) randomly selecting an insured possible winning outcome among plural insured possible winning outcomes;

(e) repeating an execution of a process in which a counting value that counts the number of played games is incremented when the insured possible winning outcome is not the outcome determined at step (a), but the counting value that counts the number of played games is not incremented when the insured possible winning outcome is the outcome at step (a); and (f) giving a special prize when the counting value becomes a predetermined number.

2. The gaming machine according to claim 1, further comprising:

a memory device which is able to store a flag; and an insurance bet device for wagering a predetermined amount;

wherein the processor is programmed to:

execute step (d) only if the flag is not stored in the memory device when the predetermined amount is wagered via the insurance bet device; and storing the flag in the memory device after the selection of the insured possible winning outcome at step (d).

3. The gaming machine according to claim 2, wherein the processor is programmed to execute steps (i) and (j) after executing step (f):

(i) calculating a remaining number of games to play indicating a number of played games necessary for the counting value to reach the predetermined number when the insured possible winning outcome is not the outcome determined at step (a) above; and (j) giving the special prize when the remaining number of games to play becomes "0".

4. The gaming machine according to claim 1, wherein the processor calculates a remaining number of games to play indicating a number of played games necessary for the counting value to reach to the predetermined number and controls the display device so as to display the remaining number of games to play calculated thereby.

5. The gaming machine according to claim 4, wherein the processor controls the display device so as to display the counting value on the display device, in addition to the remaining number of games to play.

* * * * *